US010681979B1

(12) United States Patent
Shingne et al.

(10) Patent No.: US 10,681,979 B1
(45) Date of Patent: Jun. 16, 2020

(54) EXTENDING HANGER ASSEMBLY

(71) Applicant: B/E Aerospace, Inc., Winston-Salem, NC (US)

(72) Inventors: Umesh B. Shingne, Hyderabad (IN); Deepak Chandra Kokkalla, Hyderabad (IN); Ian L. Frost, Winston-Salem, NC (US)

(73) Assignee: B/E Aerospace, Inc., Winston-Salem, NC (US)

( * ) Notice: Subject to any disclaimer, the term of this patent is extended or adjusted under 35 U.S.C. 154(b) by 0 days.

(21) Appl. No.: 16/451,508

(22) Filed: Jun. 25, 2019

(51) Int. Cl.

| | |
|---|---|
| ***A47B 61/02*** | (2006.01) |
| ***E05F 5/02*** | (2006.01) |
| ***A47F 7/26*** | (2006.01) |
| ***A47B 88/497*** | (2017.01) |
| ***A47B 61/06*** | (2006.01) |
| ***A47B 61/00*** | (2006.01) |

(52) U.S. Cl.
CPC ..... *A47B 61/02* (2013.01); *A47B 61/003* (2013.01); *A47B 61/06* (2013.01); *A47B 88/497* (2017.01); *A47F 7/26* (2013.01); *E05F 5/02* (2013.01); *E05Y 2900/20* (2013.01)

(58) Field of Classification Search
CPC ..... A47B 61/02; A47B 88/497; A47B 96/16; A47B 43/00; A47B 45/00; A47B 61/06; A47B 61/00; A47B 61/003; A47B 53/00; A47B 46/00; E05F 5/02; E05Y 2900/20; F21V 21/24; D06F 57/08; D06F 57/10; D06F 57/04; A47F 7/26; A47F 7/24; A47G 25/0664; A47G 26/0685; A47G 25/0671; A47G 26/0692
USPC .... 211/85.3, 202, 1.3, 195, 87.01, 104, 105, 211/99, 100, 101, 119.004, 94.02, 94.03; 248/298.1, 277.1; 312/205, 273, 274, 312/311, 127, 129, 130, 131, 132; 49/70
See application file for complete search history.

(56) References Cited

U.S. PATENT DOCUMENTS

| | | | | | |
|---|---|---|---|---|---|
| 38,473 | A | * | 5/1863 | Durand | A47F 3/004 312/130 |
| 590,983 | A | * | 10/1897 | Herman | A47C 7/62 211/119.007 |
| 596,380 | A | * | 12/1897 | Pursley | A47G 25/746 211/85.3 |
| 612,479 | A | * | 10/1898 | Casey | A47G 25/746 211/105 |
| 768,683 | A | * | 8/1904 | Parkhurst | A47B 61/06 190/13 C |

(Continued)

*Primary Examiner* — Jennifer E. Novosad
(74) *Attorney, Agent, or Firm* — Clements Bernard Walker

(57) ABSTRACT

An extending hanger assembly, for a wardrobe system having an enclosure and a door pivotable between open and closed positions, includes: a base on which an article support peg is mounted for linear translation; a mechanism operative to move the article support peg linearly relative to the base; and a control link coupling the door to the mechanism, whereby, upon opening and closing of the door, the control link operates the mechanism to translate the article support peg in opposing linear directions. The mechanism operative to move the article support peg linearly relative to the base can be a scissor mechanism having a proximal end extending toward the door and a distal end extending away from the door, wherein the distal end is attached to the base, and the proximal end is attached to a traveling bracket that carries the article support peg.

19 Claims, 6 Drawing Sheets

(56) References Cited

U.S. PATENT DOCUMENTS 814,165 A * 3/1906 Rea et al. ..... A47B 87/02 211/79
842,821 A * 1/1907 Tryon ..... A47B 61/02 312/205
842,940 A * 2/1907 Clark ..... A47G 25/746 211/105
853,739 A * 5/1907 Schild ..... A47G 25/746 211/105
867,567 A * 10/1907 Bast ..... A47G 25/746 211/85.3
871,673 A * 11/1907 Cavana ..... A47G 25/746 211/105
918,000 A * 4/1909 Burdick ..... D06F 57/12 211/94.03
921,212 A * 5/1909 Fassett ..... A47B 88/483 312/334.3
922,566 A * 5/1909 Corbin ..... A47G 25/746 211/105
995,771 A * 6/1911 Coyle ..... B60R 9/06 224/497
1,023,789 A * 4/1912 Miller ..... A47F 3/004 312/130
1,088,958 A * 3/1914 Barton et al. ..... A47F 3/08 312/132
1,272,819 A * 7/1918 Linnett ..... A47G 25/746 211/105
1,340,565 A * 5/1920 Seidenburg ..... A47B 61/06 211/1.3
1,379,700 A * 5/1921 Scheu ..... D06F 57/12 211/105
1,606,587 A * 11/1926 May ..... A47F 3/06 211/45
1,613,655 A * 1/1927 Hainzigianis ..... A47K 1/09 312/206
1,627,559 A * 5/1927 Haul ..... A47G 25/0685 211/105
1,704,011 A * 3/1929 Hobart ..... A47B 65/00 211/43
1,748,068 A * 2/1930 Hood ..... A47B 61/02 211/105
1,818,784 A * 8/1931 Beers ..... A47F 3/06 312/128
1,835,764 A * 12/1931 Edelheit ..... A47G 25/746 211/105
1,861,273 A * 5/1932 Hood ..... A47B 61/02 211/105
1,994,897 A * 3/1935 Sidney ..... A47G 25/746 211/105
2,143,966 A * 1/1939 Yaeger ..... H04M 1/11 248/123.2
2,237,141 A * 4/1941 Gale ..... A47H 5/04 160/125
2,255,461 A * 9/1941 Williams ..... A47G 25/746 248/277.1
2,417,387 A * 3/1947 Totty ..... A47B 61/06 190/13 C
2,560,466 A * 7/1951 Meinke ..... A47B 77/14 211/105
2,562,982 A * 8/1951 Salvador ..... A47L 19/04 211/41.6
2,702,734 A * 2/1955 Kroll ..... A47B 61/02 312/275
2,778,705 A * 1/1957 Barker ..... D06F 57/12 312/313
2,960,236 A * 11/1960 Prenveille ..... A47B 61/02 211/85.3
3,490,603 A * 1/1970 Willer ..... H05K 7/1417 211/41.17
3,606,711 A 9/1971 Lodato
3,612,284 A * 10/1971 Stoltz ..... D06F 57/12 211/1.3
3,759,475 A * 9/1973 Brown ..... H02B 1/36 248/277.1
3,801,174 A * 4/1974 Kanarr ..... A47B 61/02 312/136
3,897,122 A * 7/1975 McEvers ..... A47B 61/02 312/321
4,134,629 A * 1/1979 Hansen ..... A47B 46/005 312/246
4,168,006 A * 9/1979 Yamamoto ..... D06F 57/00 211/1.3
4,171,748 A * 10/1979 Fabian ..... A47G 25/0685 211/1.3
4,632,255 A * 12/1986 Kennedy ..... A47G 25/0685 211/1.3
4,723,819 A * 2/1988 Ramberg ..... A47F 7/08 211/129.1
4,771,206 A * 9/1988 Taylor ..... A47F 7/03 211/70
5,119,944 A * 6/1992 Milton ..... A47F 5/0093 211/104
5,366,203 A * 11/1994 Huffman ..... E04B 9/003 248/277.1
5,507,423 A 4/1996 Fischer et al.
5,551,580 A * 9/1996 Knutson ..... A47B 61/003 211/87.01
5,590,940 A * 1/1997 Richard ..... A47B 81/00 211/162
5,904,276 A * 5/1999 Chen ..... A45C 13/03 211/104
6,398,323 B1 * 6/2002 Lee ..... A47B 46/00 312/205
6,679,392 B1 * 1/2004 Costa ..... A47B 61/003 211/162
8,028,844 B2 * 10/2011 Costa ..... A47G 25/746 211/104
8,459,755 B1 * 6/2013 Shupe ..... A47B 61/06 220/6
8,540,087 B1 * 9/2013 Skaer ..... A47G 25/0685 211/100
8,622,488 B1 * 1/2014 Kilby ..... A47B 46/005 211/103
9,051,680 B1 * 6/2015 Harris ..... D06F 53/045
9,084,460 B2 * 7/2015 Richards ..... A45C 7/0031
9,622,577 B2 * 4/2017 Wirthlin ..... F41C 33/06
10,065,565 B2 9/2018 Mozurkewich et al.
2004/0070318 A1 4/2004 Shai
2004/0200791 A1 * 10/2004 Bostick ..... A47B 61/02 211/94.01
2010/0164339 A1 * 7/2010 Jenkins ..... A47B 46/00 312/330.1
2012/0080394 A1 * 4/2012 Shorty ..... A47B 61/02 211/123
2014/0225487 A1 * 8/2014 Yang ..... G06F 1/181 312/205
2016/0031354 A1 * 2/2016 Miles ..... B60P 1/4414 211/1.51

* cited by examiner

EXTENDING HANGER ASSEMBLY

BACKGROUND

Airline operators offer convenient cabin amenities for passenger use and comfort. Passengers often wear layers of clothing articles to prepare for varying weather conditions as they travel, for example on long distance trips among countries of varying climates. Business travelers often wear outer suit coats, blazers, and jackets and are particularly concerned with presentable appearances, for example as they travel to attend meetings, and may be greeted by associates, clients, or competitors without time to visit a residence, hotel, or other accommodations for a change of attire after flying. Airline employees too are expected to have professional and fresh appearances before, during, and after flights.

While access to effects such as clothing hangers is expected on need or demand, such effects are also expected to stow for convenience when not in use, particularly given the limited space in passenger cabins even in premium suite accommodations. Space savings principles apply in airline passenger cabins as much or more than in any other industry or application. Thus, hanging suit coats and other garments as needed in parallel fashion relative to wall panels is a potentially beneficial approach to save space, for example particularly in individual or small group passenger suite spaces. However, opening a large door that matches the broad area of a hanging enclosure may be an inconvenient or even unsafe operation in a small space. Also, inserting a garment on a hangar through a narrow opening into a deep slender enclosure may be inconvenient.

Accordingly, improvements are needed in garment hanging devices. More particularly, improvements are needed to automatically present a passenger with a ready hanger support and stow the hanger support from sight when not in use, among other features, uses and advantages.

SUMMARY OF THE INVENTIVE ASPECTS

To achieve the foregoing and other advantages, the inventive aspects disclosed herein are directed to an extending hanger assembly for a wardrobe system having an enclosure and a door pivotable between open and closed positions. The hanger assembly includes a base on which an article support peg is mounted for linear translation, a mechanism operative to move the article support peg linearly relative to the base, and a control link coupling the door to the mechanism, whereby, upon opening and closing of the door, the control link operates the mechanism to translate the article support peg in opposing linear directions.

In some embodiments, the mechanism operative to move the article support peg linearly relative to the base includes a scissor mechanism having a proximal end extending toward the door and a distal end extending away from the door, wherein the distal end is attached to the base, and the proximal end is attached to a traveling bracket that carries the article support peg.

In some embodiments, the control link is attached to an intermediate joint of the scissor mechanism between the proximal end and distal end.

In some embodiments, upon opening and closing of the door, the control link moves the intermediate joint of the scissor mechanism, which thereby translates the article support peg.

In some embodiments, upon opening of the door, the control link operates the mechanism to translate the article support peg in a first linear direction toward the door; and, upon closing of the door, the control link operates the mechanism to translate the article support peg in a second linear direction away from the door.

In some embodiments, the mechanism includes a first scissor actuator driven by the control link and a second scissor actuator driven by the first scissor actuator.

In some embodiments, each of the first and second scissor actuators has multiple arms pivotally interconnected at overlapped centers and terminal ends of the arms.

In some embodiments, the first scissor actuator has a distal end extending away from the door and attached to the base, and a proximal end opposite the distal end and attached to the second scissor actuator, and the second scissor actuator has a distal end extending away from the door and attached to the base, and a proximal end opposite the distal end and attached to the article support peg.

In some embodiments, the proximal end of the first scissor actuator is attached to an intermediate joint of the second scissor actuator between the proximal end and distal end thereof.

In some embodiments, each scissor actuator imparts a respective stroke amplification factor by which translation of the article support peg is greater than movement of the control link.

In some embodiments, a cover is connected to the base, wherein the article support peg extends through and moves along the slot when the mechanism translates the article support peg.

In some embodiments, a first plate and a second plate has oppositely diagonal respective slots through which the article support peg extends, the first plate and second plate cooperatively occluding the slot in the cover.

In some embodiments, the first plate and second plate move in opposite vertical directions, due to the oppositely diagonal slots, as the article support peg translates.

In some embodiments, a crossing intersection of the oppositely diagonal slots defines a minimal opening for passage and movement of the article support peg.

In some embodiments, the control link includes a gas-filled cylinder and a rod to damp motion of the door.

In another aspect, the inventive concepts disclosed herein are directed to a wardrobe system including a fixed first structure, a second structure pivotable relative to the fixed first structure between a first position and a second position, an article support peg mounted on the first structure for linear translation, a scissor mechanism operative to move the article support peg linearly relative to the first structure, and a control link coupling the second structure to the scissor mechanism, whereby, upon opening and closing of the door, the control link operates the scissor mechanism to translate the article support peg in opposing linear directions.

In some embodiments, the scissor mechanism has a proximal end extending toward the second structure and a distal end extending away from the second structure, wherein the distal end is attached to the first structure, and the proximal end is attached to a traveling bracket that carries the article support peg.

In some embodiments, the scissor mechanism includes a first scissor actuator driven by the control link and a second scissor actuator driven by the first scissor actuator.

In some embodiments, the first scissor actuator has a distal end extending away from the second structure and attached to the first structure, and a proximal end opposite the distal end and attached to the second scissor actuator; and the second scissor actuator has a distal end extending away from the second structure and attached to the first structure, and a proximal end opposite the distal end and attached to the article support peg.

In some embodiments, a first plate and a second plate have oppositely diagonal respective slots through which the article support peg extends, the first plate and second plate cooperatively occluding a slot in a cover attached to the first structure, wherein the first plate and second plate move in opposite vertical directions, due to the oppositely diagonal slots, as the article support peg translates.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated, and some features may be omitted or may be represented schematically in the interest of clarity. Like reference numbers in the drawings may represent and refer to the same or similar element, feature, or function. In the drawings.

DETAILED DESCRIPTION

The description set forth below in connection with the appended drawings is intended to be a description of various, illustrative embodiments of the disclosed subject matter. Specific features and functionalities are described in connection with each illustrative embodiment; however, it will be apparent to those skilled in the art that the disclosed embodiments may be practiced without each of those specific features and functionalities. The aspects, features and functions described below in connection with one embodiment are intended to be applicable to the other embodiments described below except where expressly stated or where an aspect, feature or function is incompatible with an embodiment.

A wardrobe system is provided for use in a passenger suite for example where garments and garment bags carried by passengers are to be hung and stowed. The wardrobe system takes minimal space and can be situated, for example, along a wall, with a closing door, to be visibly inconspicuous and continuous with the overall look of a passenger suite. An actuating hanger assembly within an enclosure automatically presents a user with an article support peg near the opening of the enclosure when the door is opened. The actuating hanger assembly automatically stows the article support peg upon closure of the door to stow any articles such as a coat on a hanger placed on the support peg by a passenger. The articulating hanger assembly has a base mounted on a fixed panel within the interior of the enclosure, and an actuator that automatically moves the article support peg into an access position near the open doorway and a stowed position deeper within the enclosure as the door is opened and closed.

Figure 1:
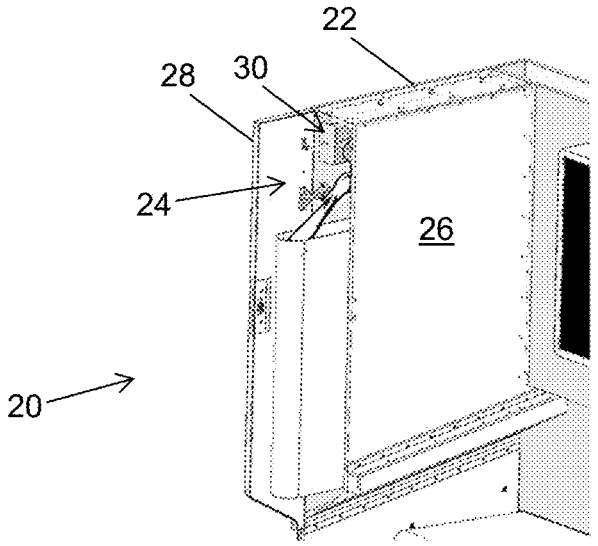
FIG. 1 is a perspective view of a wardrobe system with extending hanger assembly according to the present disclosure in an open enclosure condition.
Figure 2:
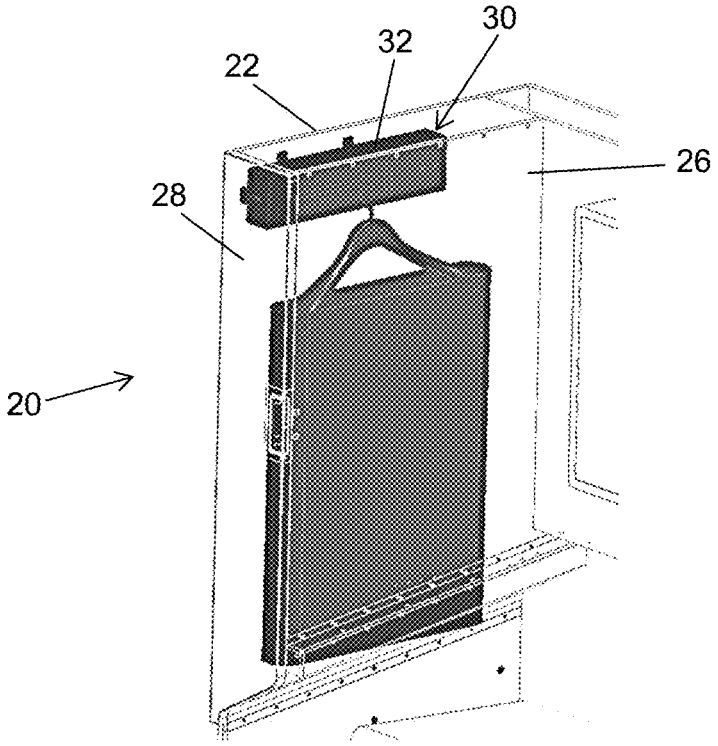
FIG. 2 is a perspective view of the wardrobe system with extending hanger assembly of FIG. 1 shown in a closed enclosure condition.

Accordingly, in the embodiment illustrated in the drawings, a wardrobe system 20 includes an extending hanger assembly 30 mounted on a first fixed structure, and a second structure that pivots relative to the first structure between a first position (FIG. 1), and a second position (FIG. 2). In the example of the drawings and throughout the following descriptions, the first fixed structure is referenced as a first fixed panel 22, which serves as an interior wall of an enclosure 24 further defined by a second fixed panel 26 spaced from the first fixed panel 22. The second structure is referenced as a door 28 hingedly attached to the first fixed panel 22, the door being pivotable between an open position as shown in FIG. 1, and a closed position as shown in FIG. 2.

Figure 3:
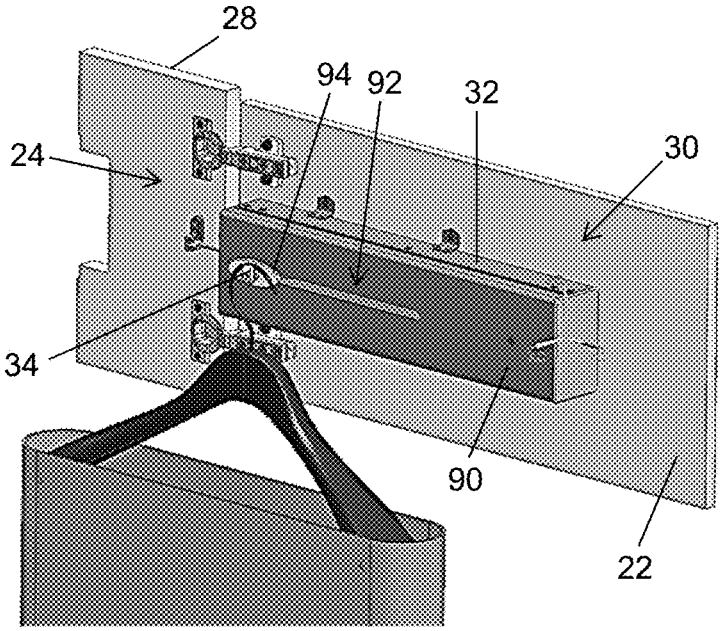
FIG. 3 is an interior perspective view of the wardrobe system with extending hanger assembly of FIG. 1 shown with the door open and the article support peg in an access position permitting mounting or dismounting of an article.
Figure 4:
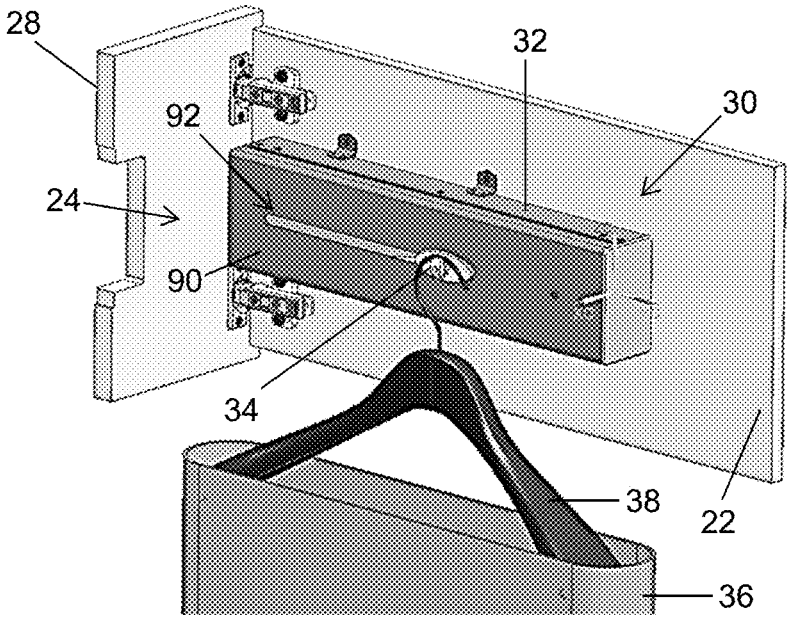
FIG. 4 is an interior perspective view of the wardrobe system with extending hanger assembly of FIG. 1 shown with the door closed and the article support peg in a stowed position for article storage.

A base 32 mounted on the first fixed panel 22 serves as a frame of the hanger assembly 30. The base 32 is stationary with the fixed panel 22 as the door 28 is opened and closed. As shown in FIG. 3, the hanger assembly 30 automatically deploys an article support peg 34 to an access position when the door 28 is opened. In the access position, the article support peg 34 is positioned sufficiently proximal the open doorway to permit the article support peg 34 to be reached and an article such as a garment 36 on a hanger 38 to be mounted on the peg 34. As shown in FIG. 4, the hanger assembly 30 automatically translates the article support peg 34 to a stowed position when the door 28 is closed. In the stowed position, the article support peg 34 is spaced sufficiently far from the closed door 28 to accommodate the garment 36 and hanger 38 mounted on the article support peg 34 within the closed enclosure 24. The structure referenced as the article support peg 34 can be a post, hook, loop, or other element, such as a hanger or other hanger support.

Figure 5:
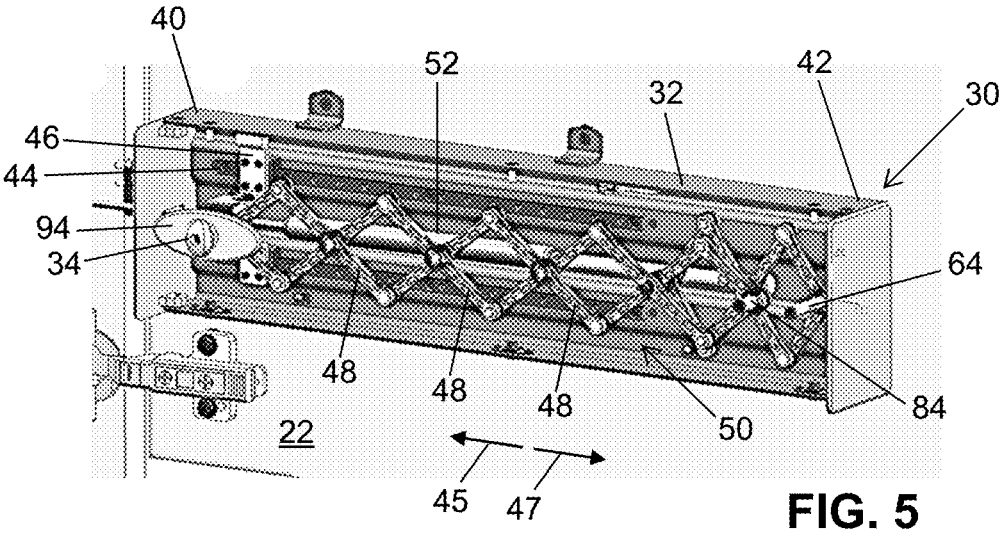
FIG. 5 is a perspective view of internal components of the wardrobe system with extending hanger assembly in the open condition of FIG. 3.
Figure 6:
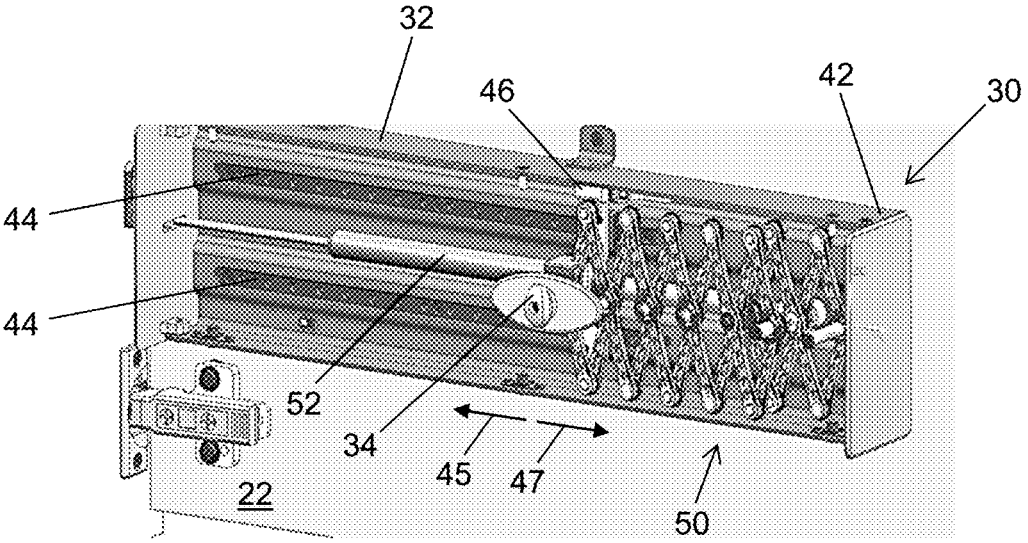
FIG. 6 is a perspective view of internal components of the wardrobe system with extending hanger assembly in the closed condition of FIG. 4.
Figure 7:
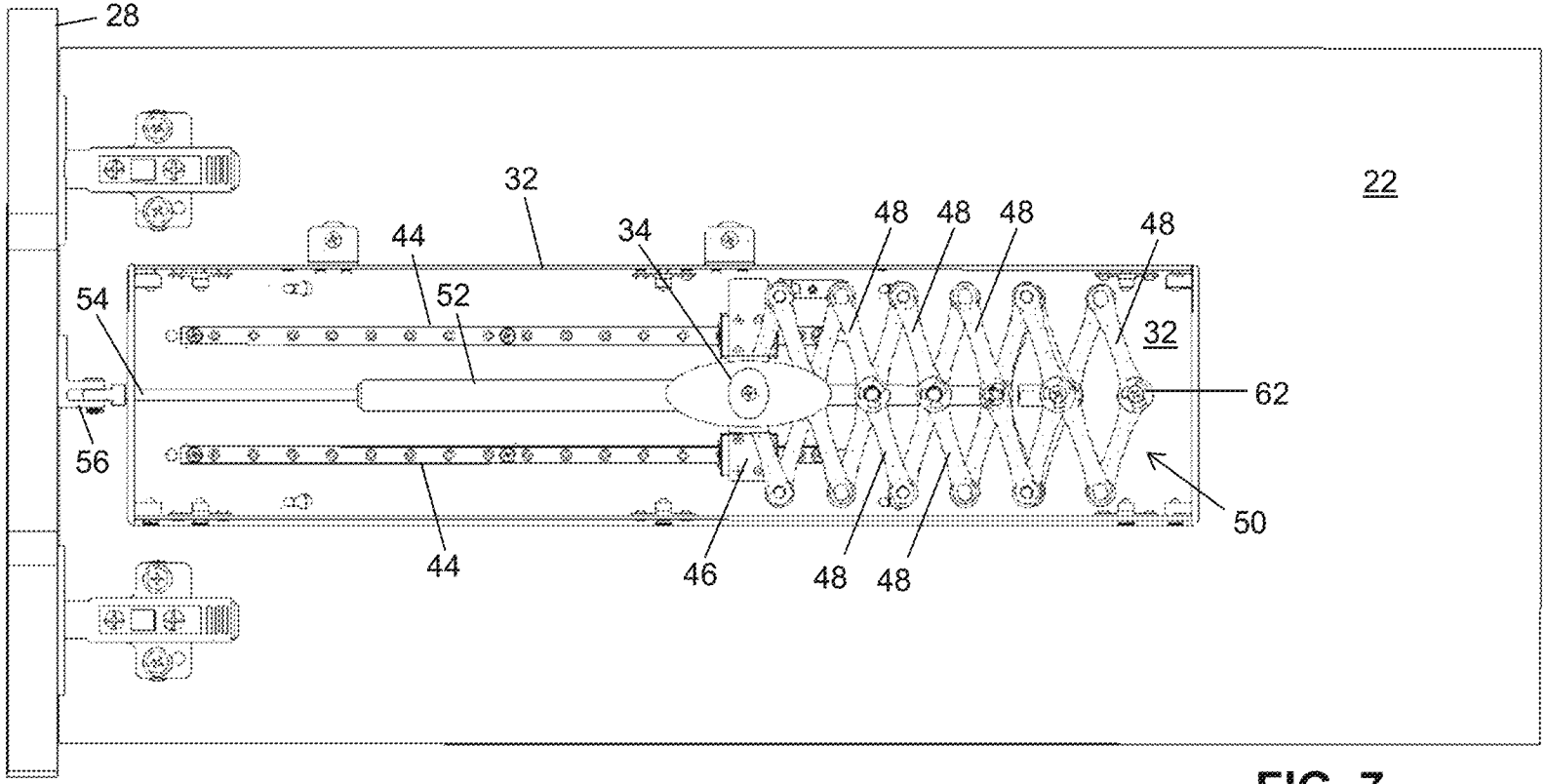
FIG. 7 is an elevation view of the mechanism as in FIG. 6.

The base 32 has a first end, referenced as the proximal end 40 with respect to relative proximity to the door 28, and a second end opposite the first end, referenced as the distal end 42 of the base 32. As shown in FIGS. 5 and 6, the hanger assembly 30 has fixed rails 44 mounted on the base 32. The base 32 is stationary with the fixed panel 22 as the door 28 is opened and closed. The article support peg 34 is mounted on and carried by a traveling bracket 46 that is engaged with, and translates along, the fixed rails 44 within the stowable hanger assembly 30. The position of the traveling bracket 46 along the rails 44 is controlled by a stroke-amplifying, dual level scissor mechanism 50. A two-ended elongate control link 52 couples the door 28 to the scissor mechanism 50 to move the traveling bracket 46 and article support peg 34 in opposing linear directions when the door 28 is opened and closed, for example by user action. A first end of the control link 52, referenced as the proximal end 54 (FIG. 7) is pivotally attached to the door 28 by way of a door-mounted bracket 56 (FIG. 7). A second end of the control link 52, referenced as the distal end 60 (FIG. 8), is attached to and actuates the dual level scissor mechanism 50 as the door is 28 is opened and closed. The control link 52 may be a gas-filled cylinder and rod type mechanism to damp the motion of the door 28 and scissor mechanism 50 against needless swinging or oscillating.

The scissor mechanism 50 has multiple arms 48 pivotally interconnected at their overlapped centers and terminal ends. Joints, defined where adjacent arms pivotally cross at their centers or pivotally join at their ends, are controllably uniformly spaced according to the dispositions of arms as the scissor mechanism is actuated by the control link 52.

The distal most joint 62, which defines the distal end of the scissor mechanism 50 extending away from the door 28, is pivotally attached to, and stationary with, the base 32 by a first fixed post 64 connected to the base. The proximal most joint 66, which defines the proximal end of the scissor mechanism 50 extending toward the door 28, is pivotally attached to the traveling bracket 46 that carries the article support peg 34. The distal end 60 of the control link 52 is pivotally attached to an intermediate joint 68. As the control link 52 moves with opening and closing of the door 28, the distal end 60 moves the intermediate joint 68 of the scissor mechanism 50, which thereby moves the traveling bracket 46 and the article support peg 34 with stroke amplification.

When the door 28 is in the closed position, the control link 52 is accordingly in its most distally extended position, and the scissor mechanism 50 is in the most collapsed condition thereof (FIG. 6,8). When the door 28 is in the open position, the control link 52 is in its least distally extended position, and the scissor mechanism 50 is accordingly in the most expanded condition thereof (FIG. 5). In a particular implementation, only three arm types, for example made of plastic, are used to make the scissor mechanism.

As the door 28 is opened, the door-mounted bracket 56 moves with the door 28, pulling the intermediate joint 68 relative to the fixed distal most joint 62 thereby expanding the scissor mechanism 50 and translating the traveling bracket 46 and article support peg 34 in a first linear direction 45 (FIG. 8) toward the opening door and access position. This permits articles such as garments and garment bags to be mounted onto or dismounted from the support peg 34. As the door 28 is closed, the door-mounted bracket 56 moves in a second linear direction 47, away from the closing door and opposite the first linear direction 45, as the control link 52 articulates the scissor mechanism, pushing the intermediate joint 68 by way of the control link 52 relative to the fixed distal most joint 62, thereby collapsing the scissor mechanism 50 and translating the traveling bracket 46 and article support peg 34 toward the distal end 42 of the base 32, further within the enclosure, and toward the stowed position. This stores any article on the support peg 34 within the enclosure and generally stows the hanger assembly 30 out of sight.

Figure 8:
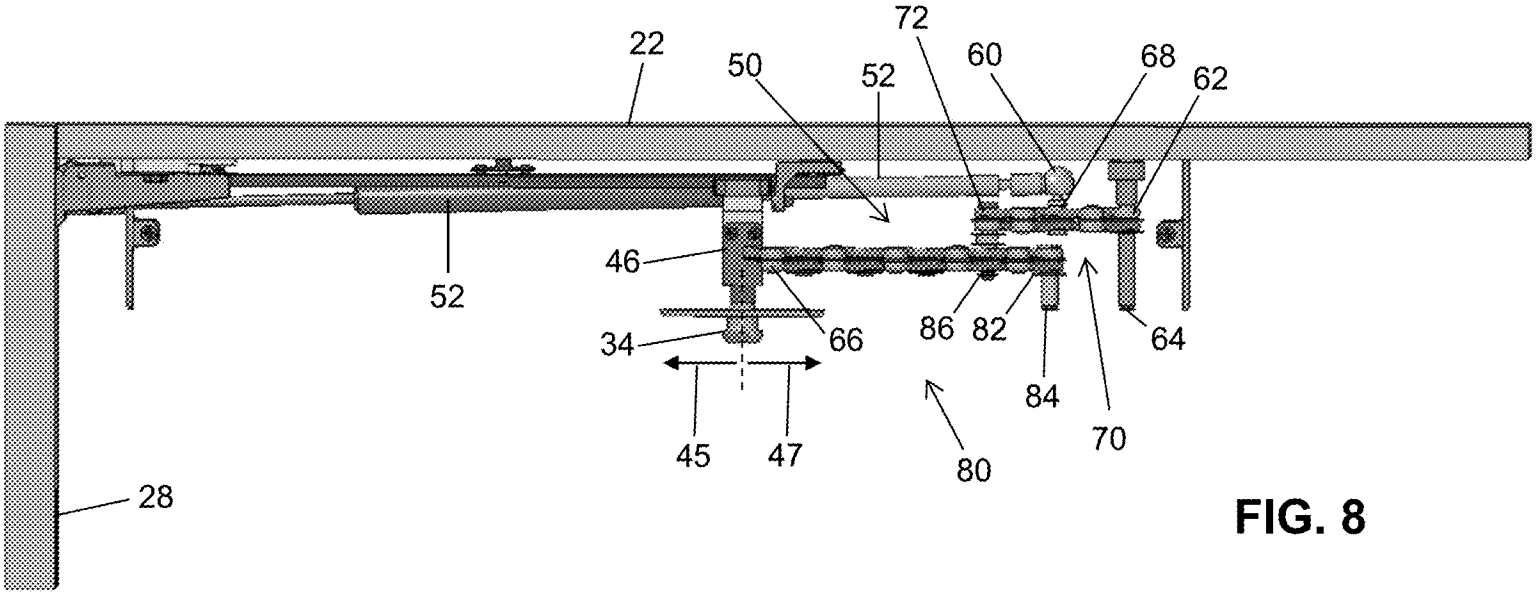
FIG. 8 is top view of the mechanism as in FIG. 6.

In a single level scissor mechanism (not illustrated), the distal most joint 62, intermediate joint 68, and proximal most joint 66, are of the same scissor actuator. As shown in FIG. 8, the illustrated scissor mechanism, however, is a dual level mechanism 50 that includes a first scissor actuator 70 (first level) driven by the control link 52, and a second scissor actuator 80 (second level) driven by the first scissor actuator 70. Each scissor actuator imparts a respective stroke amplification factor.

The first scissor actuator 70 imparts a first stroke amplification factor upon movement of the distal end 60 of the control link 52. The distal most joint 62, which defines the distal end of the scissor mechanism 50 pivotally attached to the first fixed post 64, also defines the distal end of the first scissor actuator 70 extending away from the door 28. An intermediate joint of the first scissor actuator 70 is the intermediate joint 68 to which the control link 52 is pivotally attached. A proximal most joint 72 defines the proximal end of the first scissor actuator 70 extending toward the door 28. As the control link 52 moves with opening and closing of the door 28, the control link 52 translates the intermediate joint 68 in the first and second linear directions 45 and 47 respectively, thereby moving the proximal most joint 72 of the first scissor actuator 70.

The second scissor actuator 80 imparts a second stroke amplification factor upon movement of the proximal most joint 72 of the first scissor actuator 70. The distal end of the second scissor actuator 80 extending away from the door 28 is defined by a distal most joint 82 pivotally attached to a second fixed post 84, which is spaced from the first fixed post 64. The second fixed post 84 is connected to a cover 90, which is connected to the base 32. Thus, the distal most joint 82 is pivotally attached to, and stationary with, the base 32 by way of the second fixed post 84 and cover 90.

The proximal end of the second scissor actuator 80 extending toward the door 28 is defined by the proximal most joint 66, which also defines the proximal end of the scissor mechanism 50 pivotally attached to the traveling bracket 46 and to the article support peg 34 by way of the traveling bracket. The proximal most joint 72 of the first scissor actuator 70 is pivotally attached to an intermediate joint 86 of the second scissor actuator 80. As the first scissor actuator 70 moves with opening and closing of the door 28, the proximal most joint 72 of the first scissor actuator translates the intermediate joint 86 of the second actuator 80 in the first and second linear directions 45 and 47 respectively, thereby translating the proximal end (proximal most joint 66) of the second scissor actuator 80 and the traveling bracket 46 and article support peg 34 therewith in the first and second linear directions 45 and 47.

By the first and second scissor actuators 70 and 80 imparting respective stroke amplification factors, stroke amplification by the dual level scissor mechanism 50 is greater than would be achieved by a single level scissor mechanism of similar dimensions. In the illustrated embodiment, the first scissor actuator 70 has three joints. The intermediate joint 68 driven by the control link 52 is adjacent the first or distal most joint 62. The stroke amplification factor of the first scissor actuator 70 is thereby two, as movement of the proximal most joint 72 is twice that of the intermediate joint 68. The second scissor actuator 80 has six joints (see FIGS. 5 and 8). The intermediate joint 86 driven by the first scissor actuator 70 is adjacent the first or distal most joint 82. The stroke amplification factor of the second scissor actuator 80 is thereby five, as movement of the proximal most joint 66 is five times that of the intermediate joint 86. Accordingly, the total stroke multiplication of the dual level scissor mechanism 50 is ten, as movement of the proximal most joint 66 that translates the article support peg 34 is ten times that of the intermediate joint 68 moved by the control link 52.

The cover 90 (FIGS. 3,4) mounted on the enclosure side of the hanger assembly 30 opposite the first fixed panel 22 generally covers the internal components of the mechanism. This prevents, for example, fingers and hanger hooks from reaching the arms of the scissor mechanism 50 and other moving internal parts. An elongate slot 92 in the cover accommodates linear movements of the article support peg 34, which extends through the slot and moves along the slot when the scissor mechanism 50 is operated. In the illustrated embodiment, the article support peg 34 extends through the slot 92 and has an exterior side flange 94 that covers portions of the slot 92 adjacent the peg 34 along the exterior of the cover 90 as the support peg 34 moves.

Figure 10:
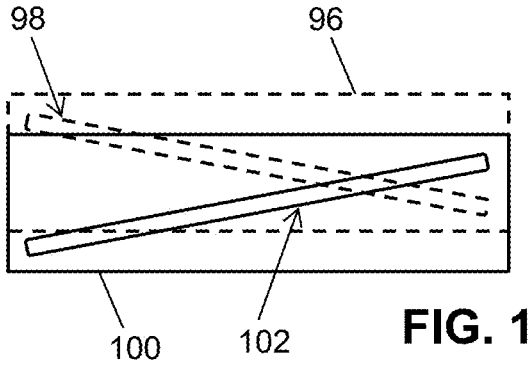
FIG. 10 shows the sliding closeout plates of FIG. 9.

To further closeout the slot 92 from entry by fingers and hanger hooks and such, moving adjacent slider plates under the cover 90 cooperatively occlude the slot beyond the flange 94 as the support peg 34 moves. A first slider plate 96 (shown in dashed line in FIG. 10) has a diagonal slot 98 that distally declines. A second slider plate 100 (shown in solid line in FIG. 10) has an oppositely diagonal slot 102 that distally inclines. In any position of the slider plates and support peg 34, the support peg 34 extends, in order, from the traveling bracket 46, through the first slider plate 96, second slider plate 100, and cover 90. The crossing intersection of the oppositely diagonal slots of the moving slider plates defines a dynamic minimal opening for passage and movement of the support peg 34.

Figure 9:
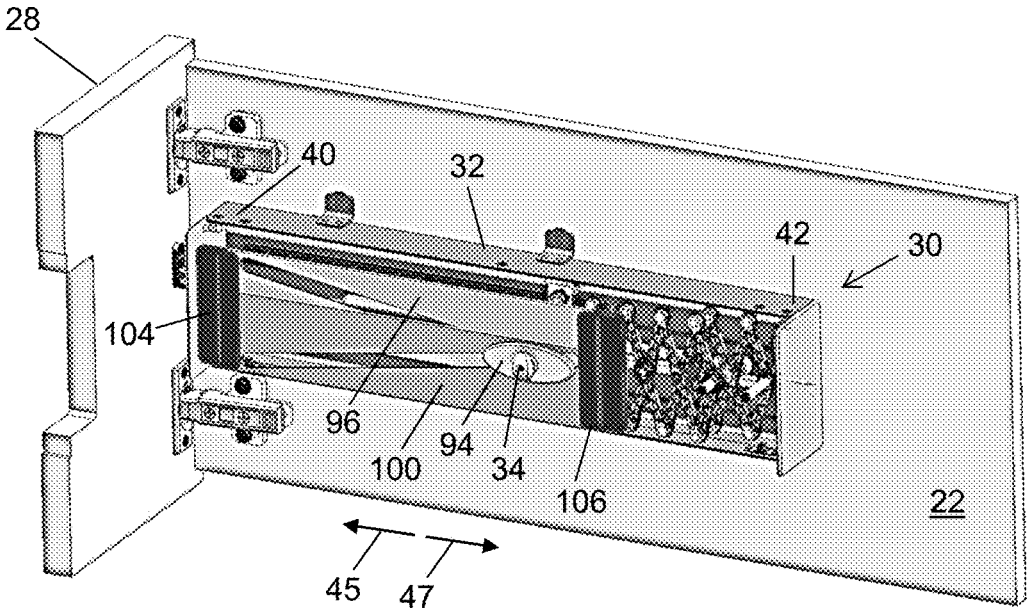
FIG. 9 is a perspective view of the mechanism as in FIG. 6, shown additionally with sliding closeout plates.

The slider plates 96 and 100 are permitted to move vertically within the hanger assembly 30 by a proximal guide 104 and a distal guide 106 (FIG. 9). The slider plates 96 and 100 move in opposite vertical directions as the article support peg 34 moves due to the oppositely diagonal slots 98 and 102. As the support peg 34 moves in the second linear direction 47 toward the distal stowed position, the first slide plate 96 rises and the second slider plate 100 lowers as their slots engage the peg 34. As the support peg 34 moves in the first linear direction 45 toward the proximal access position, the first slider plate 96 lowers and the second slider plate 100 rises. Thus, the cover 90, the first slider plate 96, and the second slider plate 100 together close out the hanger assembly 30 from the outward side relative to the first fixed panel 22. This protects the internal components of the mechanism from inadvertent obstruction and provides an outer aesthetic appearance in other mounting examples where the hanger assembly 30 is in view, such as where there is no enclosure, the second fixed panel 26 is transparent, or when a viewing window encloses the mechanism and stowage space.

While the foregoing description provides embodiments of the invention by way of example only, it is envisioned that other embodiments may perform similar functions and/or achieve similar results. Any and all such equivalent embodiments and examples are within the scope of the present invention and are intended to be covered by the appended claims.

What is claimed is:

1. An extending hanger assembly for a wardrobe system having an enclosure and a door pivotable between open and closed positions, the hanger assembly comprising:

a base adapted to mount to the enclosure and on which an article support peg is mounted for linear translation;

a mechanism operative to move the article support peg linearly relative to the base, the mechanism comprising a scissor mechanism having a proximal end adapted to extend toward the door and a distal end adapted to extend away from the door, wherein the distal end is attached to the base and the proximal end is attached to a traveling bracket that carries the article support peg; and a control link adapted to couple the door to the mechanism, whereby, upon the door pivoting between the open and closed positions, the control link operates the mechanism to translate the article support peg.

2. The extending hanger assembly of claim 1, wherein the control link is attached to an intermediate joint of the scissor mechanism between the proximal end and the distal end.

3. The extending hanger assembly of claim 2, wherein, upon the door pivoting between the open and closed positions, the control link moves the intermediate joint of the scissor mechanism, which thereby translates the article support peg.

4. The extending hanger assembly of claim 1, wherein, upon pivoting the door toward the open position, the control link operates the mechanism to translate the article support peg in a first linear direction toward the door; and, upon pivoting the door toward the closed position, the control link operates the mechanism to translate the article support peg in a second linear direction away from the door.

5. The extending hanger assembly of claim 1, wherein the mechanism comprises:

a first scissor actuator driven by the control link; and a second scissor actuator driven by the first scissor actuator.

6. The extending hanger assembly of claim 5, wherein each of the first and second scissor actuators has multiple arms pivotally interconnected at overlapped centers and terminal ends of the arms.

7. The extending hanger assembly of claim 5, wherein:

the first scissor actuator has a distal end extending away from the door and attached to the base, and a proximal end opposite the distal end and attached to the second scissor actuator; and the second scissor actuator has a distal end extending away from the door and attached to the base, and a proximal end opposite the distal end and attached to the article support peg.

8. The extending hanger assembly of claim 7, wherein the proximal end of the first scissor actuator is attached to an intermediate joint of the second scissor actuator between the proximal end and distal end thereof.

9. The extending hanger assembly of claim 5, wherein each scissor actuator imparts a respective stroke amplification factor by which translation of the article support peg is greater than movement of the control link.

10. The extending hanger assembly of claim 1, further comprising a cover connected to the base, wherein the article support peg extends through and moves along a slot when the mechanism translates the article support peg.

11. The extending hanger assembly of claim 10, further comprising a first plate and a second plate having oppositely diagonal respective slots through which the article support peg extends, the first plate and second plate cooperatively occluding the slot in the cover.

12. The extending hanger assembly of claim 11, wherein the first plate and second plate move in opposite vertical directions, due to the oppositely diagonal slots, as the article support peg translates.

13. The extending hanger assembly of claim 12, wherein a crossing intersection of the oppositely diagonal slots defines a minimal opening for passage and movement of the article support peg.

14. The extending hanger assembly of claim 1, wherein the control link comprises a gas-filled cylinder and a rod to damp motion of the door.

15. A wardrobe system comprising:

a fixed enclosure;

a door pivotable relative to the enclosure between a first position and a second position;

an article support peg mounted on the enclosure for linear translation;

a scissor mechanism operative to move the article support peg linearly relative to the enclosure; and a control link coupling the door to the scissor mechanism, whereby, upon the door pivoting relative to the enclosure between the first position and the second position, the control link operates the scissor mechanism to translate the article support peg.

16. The wardrobe system of claim 15, wherein the scissor mechanism has a proximal end extending toward the door and a distal end extending away from the door, wherein the distal end is attached to the enclosure, and the proximal end is attached to a traveling bracket that carries the article support peg.

17. The wardrobe system of claim 15, wherein the scissor mechanism comprises: a first scissor actuator driven by the control link; and a second scissor actuator driven by the first scissor actuator.

18. The wardrobe system of claim 17, wherein:

the first scissor actuator has a distal end extending away from the door and attached to the enclosure, and a proximal end opposite the distal end and attached to the second scissor actuator; and the second scissor actuator has a distal end extending away from the door and attached to the enclosure, and a proximal end opposite the distal end and attached to the article support peg.

19. The wardrobe system of claim of claim 15, further comprising a first plate and a second plate having oppositely diagonal respective slots through which the article support peg extends, the first plate and second plate cooperatively occluding a slot in a cover attached to the enclosure, wherein the first plate and second plate move in opposite vertical directions, due to the oppositely diagonal slots, as the article support peg translates.

* * * * *